US005669664A

United States Patent [19]

Perego

[11] Patent Number: 5,669,664

[45] Date of Patent: Sep. 23, 1997

[54] HIGHCHAIR WITH IMPROVED RECLINING MECHANISM

[75] Inventor: Gianluca Perego, Arcore, Italy

[73] Assignee: Peg Perego Pines, S.p.A., Milan, Italy

[21] Appl. No.: 680,607

[22] Filed: Jul. 16, 1996

[30] Foreign Application Priority Data

Jul. 25, 1995 [IT] Italy ..... MI950538 U

[51] Int. Cl.[6] ..... A47C 1/02

[52] U.S. Cl. ..... 297/327; 297/376

[58] Field of Search ..... 297/326, 327, 297/328, 376, 354.1, 354.11, 354.12, 354.13, 359, 148, 149

[56] References Cited

U.S. PATENT DOCUMENTS

| | | | |
|---|---|---|---|
| 207,621 | 9/1878 | Patten | 297/359 X |
| 3,572,827 | 3/1971 | Merelis et al. | 297/328 X |
| 3,649,074 | 3/1972 | McDonald et al. | 297/327 X |
| 4,632,456 | 12/1986 | Kassai | 297/327 X |
| 5,246,272 | 9/1993 | Kato et al. | 297/354.12 X |

FOREIGN PATENT DOCUMENTS

| | | | |
|---|---|---|---|
| 576431 | 5/1958 | Italy | 297/354.12 |

*Primary Examiner*—Milton Nelson, Jr.
*Attorney, Agent, or Firm*—McGlew and Tuttle

[57] ABSTRACT

A highchair comprises a child's chair and a supporting frame on which the chair is supported. The chair has at least one portion which is reclinable by a manual adjusting device. The adjusting device is movable between a position allowing free adjustment and a locked position in which adjustment is prevented. The manual adjusting device includes an operating element disposed on the backrest of the chair for movement between the locked position and the position of free adjustment. Advantageously, the entire chair forms the reclinable portion.

17 Claims, 1 Drawing Sheet

HIGHCHAIR WITH IMPROVED RECLINING MECHANISM

BACKGROUND OF THE INVENTION

This invention refers to a highchair having a reclinable seat portion.

It is a well known fact that there are highchairs having seats with reclinable backrests. The inclination of the backrest is usually adjustable to a certain number of pre-established positions by means of a pair of couplings, that can be operated individually, disposed on either side of the backrest.

The disadvantage of these known highchairs is that both hands must be used to-be able to unlock the two independent couplings, thereby making it difficult to shift the backrests into the desired position.

A further disadvantage is that the sitting position shifts from the ideal position as the inclination of the backrest is varied, the lower seat portion remaining fixed.

SUMMARY OF THE INVENTION

The general scope of this invention is to obviate the aforementioned problems by providing a highchair having a chair with a reclinable portion that can be operated with just one hand. Moreover, a further scope is to provide a chair that is completely inclinable, also with just one hand.

These scopes are achieved, according to the invention, by providing a highchair comprising a chair and a supporting frame on which the chair is supported, the chair having at least one portion which is reclinable by means of manual adjusting means which are movable between a position allowing free adjustment and a locked position in which adjustment is prevented, characterized by the fact that the manual adjusting means comprise an operating element disposed on the backrest of the chair for their movement between the locked position and the position of free adjustment.

BRIEF DESCRIPTION OF THE DRAWINGS

The innovative principles of this invention and its advantages with respect to the known technique will be more clearly evident from the following description of a possible exemplificative and non-restrictive embodiment applying such principles, with reference to the accompanying drawings, in which.

DETAILED DESCRIPTION OF THE INVENTION

Figure 1:
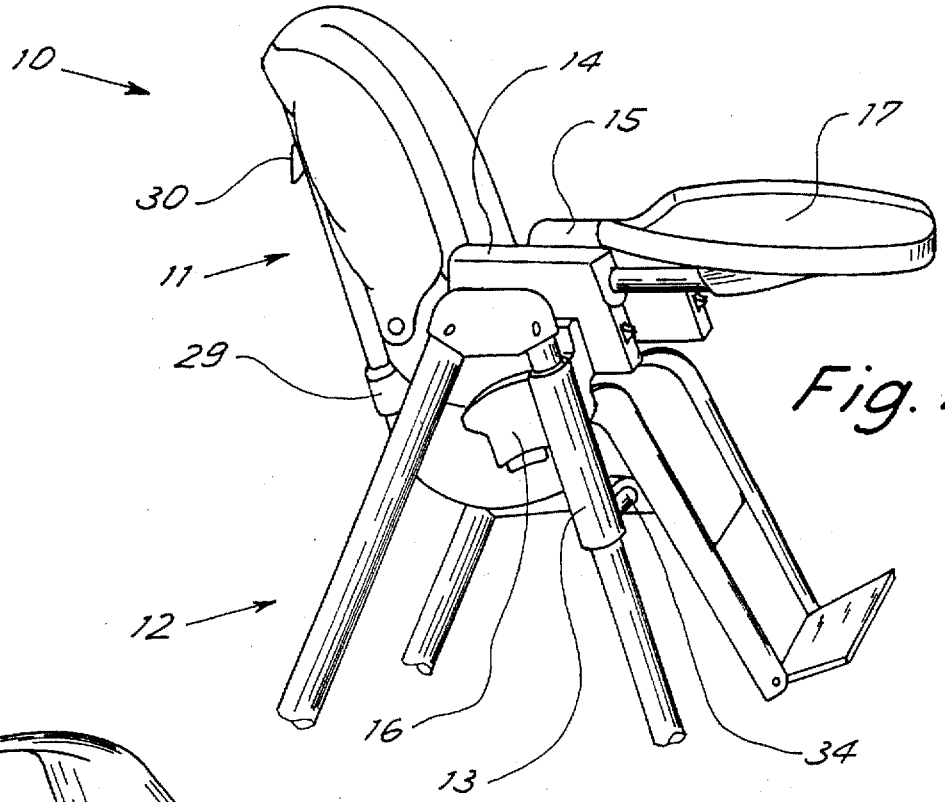
FIG. 1 shows a partial schematic perspective view of a highchair according to the invention.

With reference to the figures, FIG. 1 shows a highchair, generically indicated by reference 10, having a chair 11 and a supporting frame 12, if necessary foldable according to the known technique. The chair is secured to the frame by means of a pair of cursors 13 (of which only one is shown, the other being specularly identical). Each cursor 13 bears a respective lateral shoulder 14, 15 and the cursors if necessary can slide along the frame, by means of releasable button-operated couplings 16, so as to allow the chair to be adjusted in height from the floor. A tray 17 can be anteriorly secured to the shoulders 14, 15.

Figure 2:
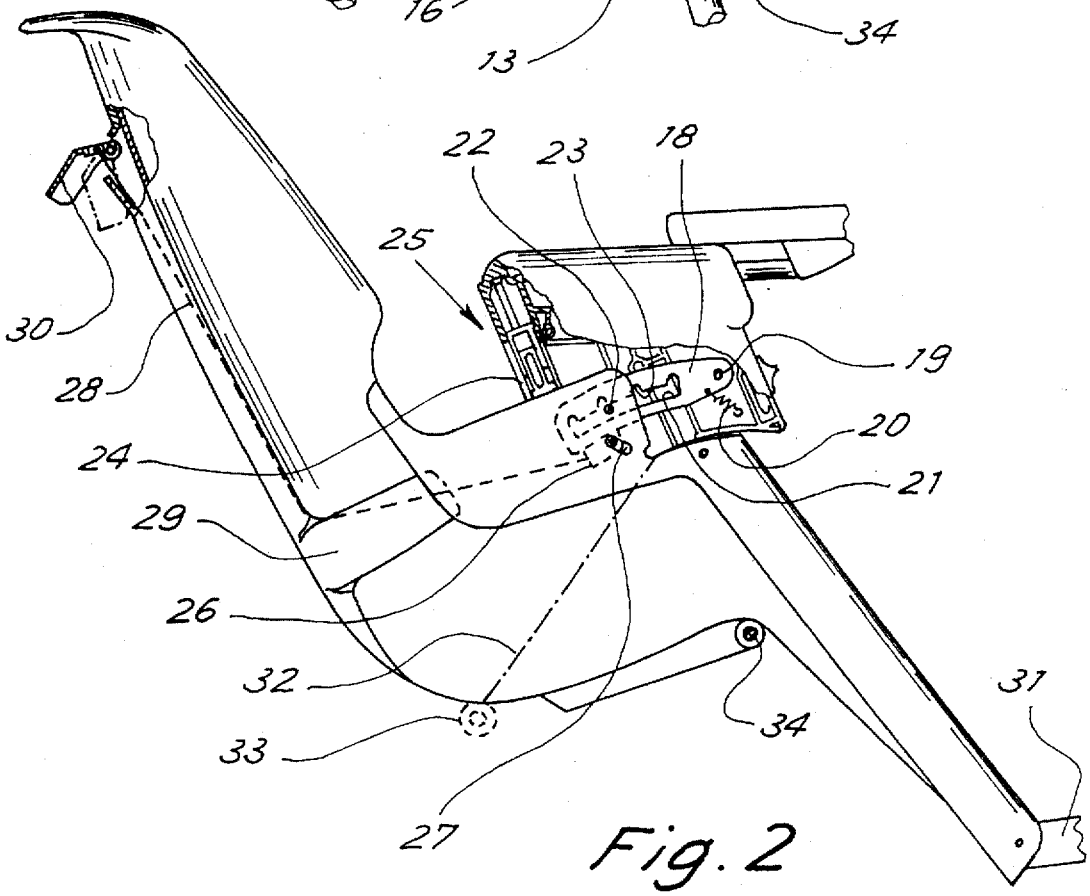
FIG. 2 shows a partial cutaway side view of the reclinable highchair and its adjusting mechanism.

As can be clearly seen in FIG. 2, the chair (advantageously made rigid and if necessary padded) is pivoted to the frame (by means of the cursors) in correspondence with a transversal axis of rotation 34 disposed beneath the seat. Side walls of the chair enter the shoulders through slots made to the rear of the shoulders themselves. In order to keep the entrance space not occupied by the side walls closed, slide obturator shutters 25 are provided which move upwards following the movement of inclination of the chair, as will be described further on.

Each shoulder contains an arm 18, pivoted by 19 to the respective shoulder to rotate downwards under the action of a spring 20.

The arms have a slot 21 forming a slideway for a pin 22 secured to the respective side wall of the chair. The upper part of the slot 21 is provided with a plurality of notches 23 which receive the respective pin 22 thanks to the action of rotation exerted by the'spring 20.

Coupling means are thus achieved on both sides of the chair to maintain the chair in one of a plurality of inclinations. Only one of these two coupling means is shown clearly in the drawings, the other being specularly identical.

Disposed beneath each arm 18 is a cursor 26, free to slide along a slanted slot 27 made in the wall of the chair. Each cursor 27 is connected to a tension wire 28 (for example a steel cable) which runs through a box-shaped element 29 of the chair. The two tension wires (one for each arm) converge in an operating lever or handle 30 pivoted to the rear of the backrest of the chair.

The slanted slot 27 is of such length that when the handle 30 is not raised (consequently in the position shown by the broken line in FIG. 2), the spring 20 pushes the arm 18 downwards until the pin 22 engages in a notch 23. As shown in FIG. 2, by pulling the handle upwards the cursor shifts along the slot until it raises the lever 18 just enough to disengage the pin 22 from the notch 23 and shift it into the slot 21, so that the inclination of the chair can be freely varied.

At this point it will be clear how the intended scopes have been achieved. It can be understood from the description of the adjusting mechanism that the adjustment is extremely quick and simple to carry out even with just one hand. Moreover, the movement of inclining the entire chair (including the footrest 31) ensures that the baby is always sitting in a correct position.

The foregoing description of an embodiment applying the innovative principles of this invention is obviously given by way of example in order to illustrate such innovative principles and should not therefore be understood as a limitation to the sphere of the invention claimed herein. For example, the exact shape of the various parts will also depend upon the particular aesthetical features required. Although a completely inclinable chair is preferable, if desired the mechanism described above can also be used just for inclination of the backrest, with modifications easily imaginable by the expert in the field, such as for example, as shown in FIG. 2, the separation of the seat and backrest along the broken line 32 and hinging of the backrest portion by means of a pin 33.

What is claimed is:

1. A highchair comprising:

a chair; and a supporting frame on which the chair is supported, the chair having at least one portion which is reclinable by means of manual adjusting means which are movable between a position allowing free adjustment and a locked position in which adjustment is prevented, the manual adjusting means comprising an operating element disposed on the backrest of the chair for their movement between the locked position and the position of free adjustment, lateral shoulders being secured to the frame on the sides of the chair and the adjusting means having fixing arms movable between the position of free adjustment and the locked position, engaging the lateral shoulders with the at least one portion which is reclinable, to fix said at least one portion which is reclinable relative to the lateral shoulders, the operating element comprising an operating lever disposed on the backrest and connected by means of tension wires to said fixing arms.

2. A highchair as claimed in claim 1, wherein said fixing arms are provided on opposing sides of said chair, said arms being rotatable in a vertical plane between a first and a second position constituting, respectively, said locked position and said position of free adjustment, each arm comprising a plurality of notches disposed along a slideway for a pin connected to said at least one portion which is reclinable, in said first position each arm engaging with one of said notches on the corresponding pin to block said at least one portion which is reclinable in a pre-established inclination, and in said second position disengaging said notches from the pin to permit free inclination of the inclinable portion.

3. A highchair as claimed in claim 2, further comprising: a cursor connected to said tension wire, said cursor being movable, by traction of the tension wire, in a direction of rotation of the corresponding arm towards the second position.

4. A highchair as claimed in claim 2, wherein each arm is contained and pivoted inside one of said lateral shoulders.

5. A highchair as claimed in claim 4, wherein said reclinable portion has side walls which extend towards the inside of said shoulders, through passages in said shoulders, and which support the pins which engage in the notches.

6. A highchair as claimed in claim 5, wherein said passages in said shoulders have slide valve shutters.

7. A highchair as claimed in claim 1, wherein said reclinable portion comprises the entire chair.

8. A highchair as claimed in claim 1, wherein said reclinable portion consists of the backrest of said chair.

9. A highchair comprising:

a chair with a backrest and seat part;

a supporting frame on which the chair is supported, the chair having at least one portion which is reclinable;

lateral shoulders secured to the frame on sides of the chair; and manual adjusting means including an operating element disposed on said backrest, said operating element being movable between a locked position and a position of free adjustment, including fixing arms movable between the position of free adjustment and the locked position, engaging the lateral shoulders with the at least one portion which is reclinable, to fix said at least one portion which is reclinable relative to the lateral shoulders, and including transmission means extending from said operating element to said fixing arms for moving said fixing arms upon movement of said operating element between said position allowing free adjustment and said locked position in which adjustment is prevented.

10. A highchair as claimed in claim 9, wherein said transmission means comprises a tension wire and said fixing arm comprises a cursor connected to said tension wire, said cursor being movable, by traction of the tension wire.

11. A highchair as claimed in claim 9, wherein said fixing arms are provided on opposing sides of said chair, said fixing arms being rotatable in a vertical plane between a first and a second position constituting, respectively, said locked position and said position of free adjustment, each of said fixing arms comprising a plurality of notches disposed along a slideway for a pin connected to said at least one portion which is reclinable, in said first position each arm engaging with one of said notches on the corresponding pin to block said at least one portion which is reclinable in a pre-established inclination, and in said second position disengaging said notches from the pin to permit free inclination of the inclinable portion.

12. A highchair as claimed in claim 11, wherein said transmission means comprises a tension wire and said fixing arm comprises a cursor connected to said tension wire, said cursor being movable, by traction of the tension wire, in a direction of rotation of the corresponding arm towards the second position.

13. A highchair as claimed in claim 11, wherein each arm is contained and pivoted inside one of said lateral shoulders.

14. A highchair as claimed in claim 13, wherein said reclinable portion has side walls which extend towards the inside of said shoulders, through passages in said shoulders, and which support the pins which engage in the notches.

15. A highchair as claimed in claim 14, wherein said passages in said shoulder have slide valve shutters.

16. A highchair as claimed in claim 9, wherein said reclinable portion comprises the entire chair.

17. A highchair as claimed in claim 9, wherein said reclinable portion consists of the backrest of said chair.

* * * * *